US005276382A

United States Patent [19]

Stocker et al.

[11] Patent Number: 5,276,382

[45] Date of Patent: Jan. 4, 1994

[54] LEAD ATTACHMENT FOR ELECTROLUMINESCENT LAMP

[75] Inventors: Sharlyn R. Stocker, Mesa; Ralph McGuigan; Rodney T. Eckersley, both of Tempe; Will M. Hooke, Phoenix, all of Ariz.

[73] Assignee: Durel Corporation, Tempe, Ariz.

[21] Appl. No.: 747,846

[22] Filed: Aug. 20, 1991

[51] Int. Cl.[5] ..... H05B 33/12; H05B 33/22

[52] U.S. Cl. ..... 313/506; 313/511; 313/512

[58] Field of Search ..... 313/498, 506, 511, 512

[56] References Cited

U.S. PATENT DOCUMENTS

| | | | |
|---|---|---|---|
| 2,928,974 | 3/1980 | Mash | 313/108 |
| 2,944,177 | 7/1960 | Piper | 313/108 |
| 3,110,836 | 11/1963 | Blazek et al. | 313/108 |
| 3,110,837 | 11/1963 | Wollentin | 313/108 |
| 3,114,853 | 12/1963 | Bouchard | 313/108 |
| 3,148,299 | 9/1964 | Devol et al. | 313/108 |
| 3,157,813 | 11/1964 | Bowser et al. | 313/512 |
| 3,315,111 | 4/1967 | Jaffe et al. | 313/108 |
| 3,320,459 | 5/1967 | Stone | 313/512 |
| 3,497,750 | 2/1970 | Knochel et al. | 313/108 |
| 3,519,871 | 7/1970 | Kanie | 313/108 |
| 3,895,208 | 7/1975 | Kraus | 219/68 |
| 4,097,776 | 6/1978 | Allinikov | 313/502 |
| 4,425,496 | 1/1984 | Le Fur et al. | 219/384 |
| 4,455,324 | 6/1984 | Kamijo et al. | 427/66 |
| 4,534,743 | 8/1985 | D'Onofrio et al. | 445/24 |
| 4,614,668 | 9/1986 | Topp et al. | 427/66 |
| 4,626,742 | 12/1986 | Mental | 313/503 |
| 4,647,337 | 3/1987 | Simopoulos et al. | 156/633 |
| 4,665,342 | 5/1987 | Topp et al. | 313/505 |
| 4,684,353 | 8/1987 | deSouza | 445/51 |
| 4,745,334 | 5/1988 | Kawachi | 313/512 |
| 4,856,392 | 8/1989 | Appelberg | 83/40 |
| 4,904,901 | 2/1990 | Simopoulos et al. | 313/509 |

FOREIGN PATENT DOCUMENTS

| | | | |
|---|---|---|---|
| 3541950 | 6/1986 | Fed. Rep. of Germany | 313/572 |

*Primary Examiner*—Sandra L. O'Shea
*Attorney, Agent, or Firm*—Fish & Richardson

[57] ABSTRACT

An electroluminescent sheet-form lamp comprising a transparent insulation layer, a transparent first conductive layer below the insulation layer forming a first electrode, a layer of phosphor material below the first conductive layer, a layer of dielectric material below the phosphor layer, a second conductive layer below the dielectric layer forming a second electrode, and electrical connection means for applying an electrical potential between the conductive layers to cause the phosphor to transmit light through the transparent conductive layer and the transparent insulation layer, one of the conductive layers having been formed as a general conductive coating preapplied over a panel of larger dimension than the lamp, from which the lamp has been cut. The lamp provides an improved electrical connection, wherein the one conductive layer has a line of interruption which isolates a localized region of the one conductive layer from electrical continuity with a main portion of the one conductive layer, the main portion of the one conductive layer forming the respective electrode and being connected to one of the connection means to apply electrical potential thereto without applying electrical potential to the localized region, the connection means for the other of the conductive layers which forms the other of the electrodes being located in coincidence with the area of the localized region, one of the connection means employing deformation of the sheet-form lamp, whereby the electrical isolation of the localized region prevents electrical shorting between the conductive layers as a result of the deformation.

21 Claims, 7 Drawing Sheets

LEAD ATTACHMENT FOR ELECTROLUMINESCENT LAMP

BACKGROUND OF THE INVENTION

Electroluminescent (EL) lamps are powered by electrical leads that are attached to the front and rear electrodes of the lamp, e.g., by conductive adhesive and pad type connectors. Some of the uses to which the EL lamps may be put, such as backlighting in automobile dashboard displays, however, require that the attachments of the leads be mechanically robust. Conductive adhesive and pad type connectors tend to fail under rigorous environmental conditions characterized, for example, by high humidity, and are therefore insufficient in these uses. Sturdier attachments such as crimp and eyelet connectors which pierce and compress the layers of the lamp can cause contact between one of the connectors and both of the electrodes, resulting in electrical shorting of the lamp. It is known to avoid such shorting by including in a lamp an electrode layer that is screen printed or otherwise deposited onto a substrate layer and then mechanically or chemically etched away in the area where the connector to the other electrode is to be attached. But it is difficult to maintain cleanliness and registration. In addition, chemical and mechanical removal of the conductive coating adds expensive and time consuming operations. Chemical etching also uses hazardous materials and generates hazardous waste.

SUMMARY OF THE INVENTION

We have discovered that, when making an electroluminescent lamp using a generally coated substrate panel to form an electrode, by providing a line of interruption, e.g., by a laser scribed line, in the general conductive coating to isolate the main portion of the conductive coating that defines the electrode from a localized region, electrical connectors that deform the layers of the lamp may be used to provide robust connections without a danger of short circuiting the lamp. As referred to herein, "laser scribing" includes using numerical control machines, e.g., a laser and a moveable table, to form the line by moving the laser and a panel of lamps on the table or by projecting a laser beam through a mask to form the line.

Aspects of the invention pertain to an electroluminescent sheet-form lamp comprising a transparent insulation layer, a transparent first conductive layer below the insulation layer forming a first electrode, a layer of phosphor material below the first conductive layer, a layer of dielectric material below the phosphor layer, a second conductive layer below the dielectric layer forming a second electrode, and electrical connection means for applying an electrical potential between the conductive layers to cause the phosphor to transmit light through the transparent conductive layer and the transparent insulation layer, one of the conductive layers having been formed as a general conductive coating preapplied over a panel of larger dimension than the lamp, from which the lamp has been cut.

According to one aspect of the present invention, there is provided an improved electrical connection, wherein the one conductive layer has a line of interruption which isolates a localized region of the one conductive layer from electrical continuity with a main portion of the one conductive layer, the main portion of the one conductive layer forming the respective electrode and being connected to one of the connection means to apply electrical potential thereto without applying electrical potential to the localized region, the connection means for the other of the conductive layers which forms the other of the electrodes being located in coincidence with the area of the localized region, one of the connection means employing deformation of the sheet-form lamp, whereby the electrical isolation of the localized region prevents electrical shorting between the conductive layers as a result of the deformation. In preferred embodiments, the one conductive layer may be either the first conductive layer or the second conductive layer.

Preferred embodiments of either of the above aspects have one or more of the following features. Connection of the first or the second connection means to the conductive layers is formed by compression of the thickness of the sheet-form member, or by crimping the first or the second connection means onto the sheet-form member, or other means deforming the member by compression. The connection can also comprise an eyelet clamped on the sheet-form member at an opening through its thickness, or comprise a thickness-penetrating member such as a conductive pin or stake, or attach to the first and second electrodes by piercing the conductive layers, or other means that deform the member by formation of an opening. The line of interruption may begin at an outer edge of the respective conductive layer, extends away from the outer edge into the interior of the conductive layer, and turns back to the outer edge in the manner to extend about and isolate the localized region at the edge of the conductive layer. Alternatively, the line of interruption may be disposed inwardly from all edges of the respective conductive layer, the line of interruption being closed upon itself to define the localized region as an island within the perimeter of the conductive layer. The line of interruption forming the localized region is a laser scribed line. An optional insulation layer may be provided over the second conductive layer.

Preferred embodiments of the lamp can further include an edge region susceptible to formation of a detrimental, electrically conductive path, wherein the main portion of the respective conductive layer is isolated from the susceptible edge region by another, second line of interruption provided along at least a portion of the perimeter of the lamp as a result of removal of the conductive coating that leaves in place a narrow margin of conductive coating. The electrical connection for the respective conductive layer is made to the main portion and is electrically isolated from the susceptible edge region, whereby a lamp formed by cutting its outline from a panel of larger dimension provides a lamp for which the formation of the conductive path in the edge region does not cause an adverse effect.

According to another aspect of the present invention, a method of providing improved electrical connection to an electroluminescent lamp, comprises providing an electroluminescent sheet-form lamp member comprising a transparent substrate layer, a transparent first conductive layer over the substrate layer forming a first electrode, a layer of phosphor material over the first electrode layer, a layer of dielectric material over the phosphor layer, a second conductive layer over the dielectric layer forming a second electrode, and first and second connection means to the respective electrode layers for applying an electrical potential between the electrode layers to cause the phosphor to transmit light through the transparent first electrode layer and the transparent substrate. One of the conductive layers is formed as a general conductive coating preapplied over a panel of the substrate layer of larger dimension than the lamp, and is provided with a line of interruption which isolates a localized region of the one conductive layer from electrical continuity with a main portion of the layer, the main portion of the one conductive layer forming the respective electrode and having a connection made therewith to apply electrical potential thereto without applying electrical potential to the localized region. The connection for the other of the conductive layers which forms the other electrode is made in a location coincident with the area of the localized region, the connection means employing deformation of the sheet-form lamp, the electrical isolation of the localized region preventing electrical shorting between the conductive layers as a result of the deformation.

In another aspect, a general preapplied conductive coating is applied to a thin substrate, a line of interruption is formed as described and then this thin substrate is laminated to another laminate member which constitutes the other layers of the lamp structure.

According to another aspect of the present invention, an electroluminescent sheet-form lamp comprises, in successive relationship, a rear substrate layer, a preapplied conductive layer over the substrate layer forming a back electrode, a layer of dielectric material over the preapplied conductive layer, a layer of phosphor material over the dielectric layer, a transparent conductive layer applied over the phosphor layer forming a transparent electrode, and electrical connection means for applying an electrical potential between the conductive layers to cause the phosphor to transmit light through the transparent conductive layer. An improved electrical connection is provided, wherein the preapplied conductive layer that forms the back electrode has a line of interruption which isolates a localized region of the preapplied conductive layer from electrical continuity with a main portion of the preapplied conductive layer. The main portion of the preapplied conductive layer forms the rear electrode and is connected to the second connection means to apply electrical potential thereto without applying electrical potential to the localized region, the connection means for the transparent conductive layers which forms the transparent electrode being located in coincidence with the area of the localized region, one of the connection means employing deformation of the thickness of the sheet-form lamp, whereby the electrical isolation of the localized region prevents electrical shorting between the conductive layers as a result of the deformation.

Other features and advantages will become apparent from an examination of the drawings and the detailed description provided below.

DRAWINGS

FIG. 1 is a plan view of an electroluminescent lamp according to the invention showing a line of interruption about a localized region of the lamp which electrically isolates the region from the main portion of the lamp.

FIG. 1*a* is a cross-sectional view of the lamp taken along line 1*a* of FIG. 1, i.e., through the line of interruption, showing the various layers of the lamp.

FIG. 1*b* is a cross-sectional view of the lamp taken along line 1*b* of FIG. 1, showing the various layers of the lamp at a position spaced from the line of interruption.

FIG. 1*c* is a plan view of an electroluminescent lamp according to the invention showing a line of interruption about a localized region of the lamp and a line of interruption about the perimeter of the lamp, which electrically isolate the localized region and a margin portion from the main portion of the lamp.

FIG. 1*d* is a cross-sectional view of the lamp taken along line 1*a* of FIG. 1*c*, i.e., through the lines of interruption, showing the various layers of the lamp.

Figure 3:
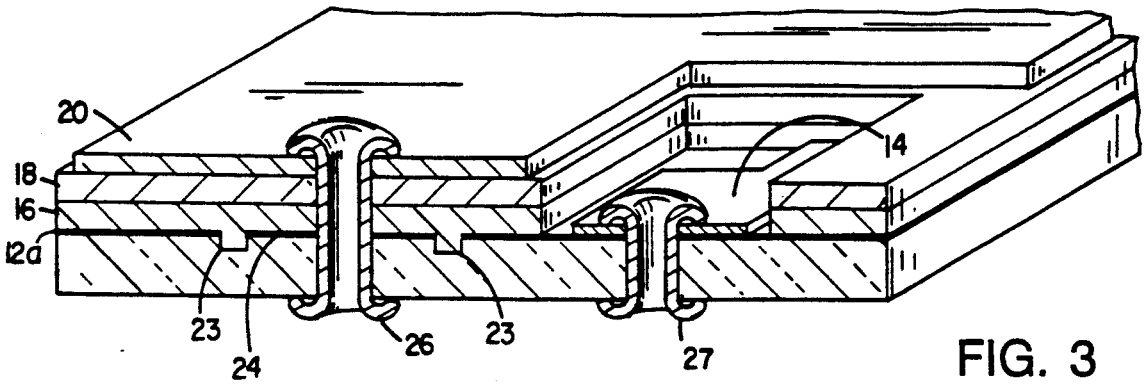
FIG. 3 is a cross-sectional isometric view of the lamp of FIG. 1 showing attachment of eyelet connectors.
Figure 4:
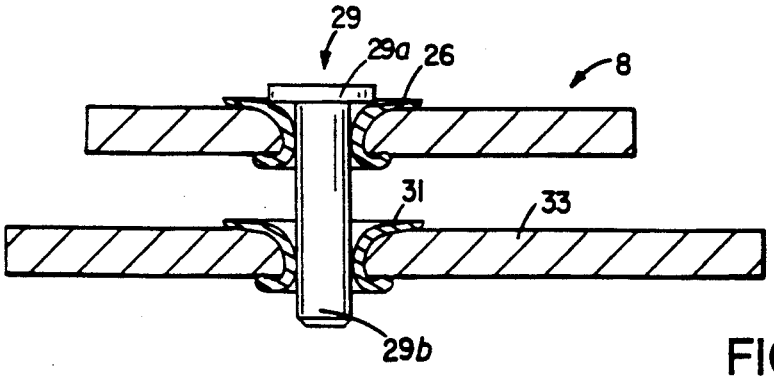
Figure 4A:
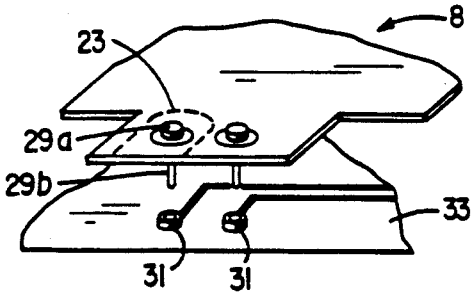

FIGS. 4 and 4*a* are a cross-sectional view and a perspective view, respectively, of the lamp of FIG. 3 showing the lamp attached to a printed circuit board by a pin and eyelet arrangement.

Figure 5:
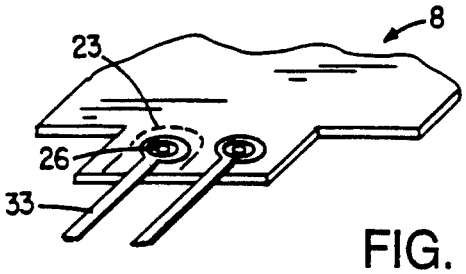

FIG. 5 is a view similar to FIG. 4*a* of an alternative embodiment of the lamp showing the lamp with solderable copper ribbon leads.

Figure 6:
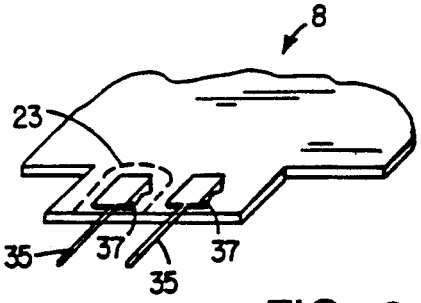

FIG. 6 is a view also similar to FIG. 4*a* of an alternative embodiment of the lamp showing the lamp with crimp style connectors.

Figure 7:
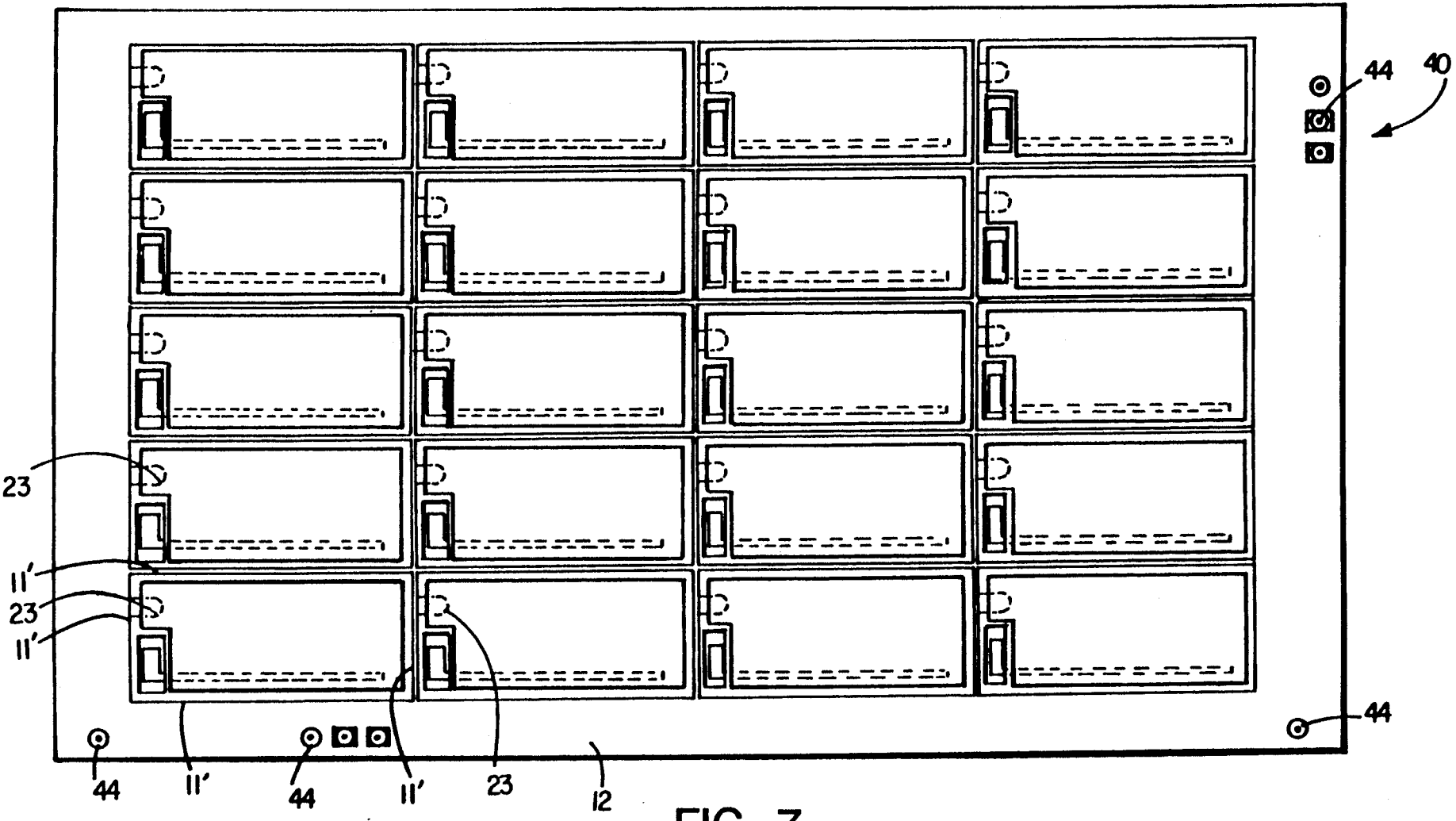

FIG. 7 is a plan view of a panel of lamps which are manufactured simultaneously.

Figure 8:
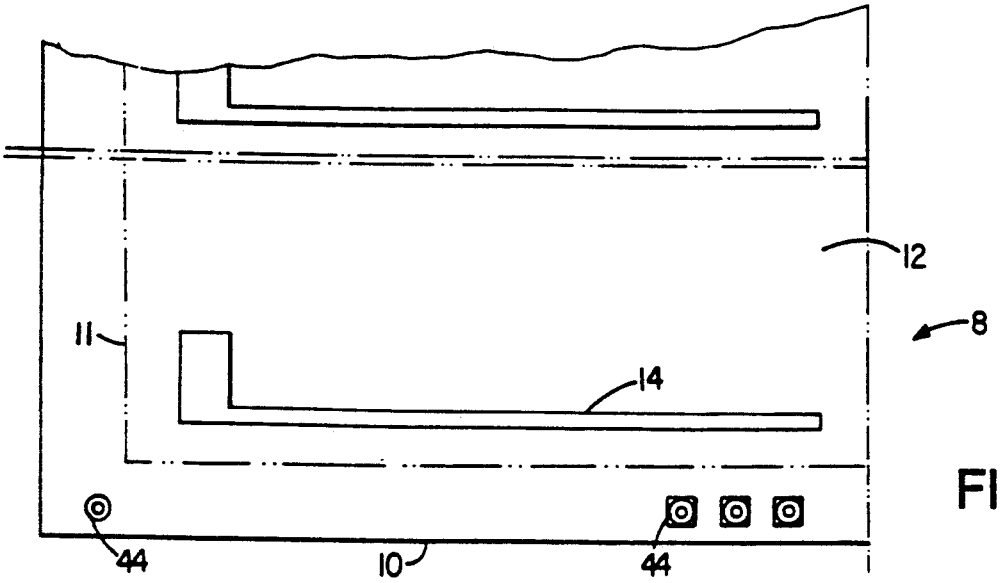

FIG. 8 is a view of a portion of the panel after a silver bus bar has been applied to the first conductive layer of a lamp.

Figure 8A:
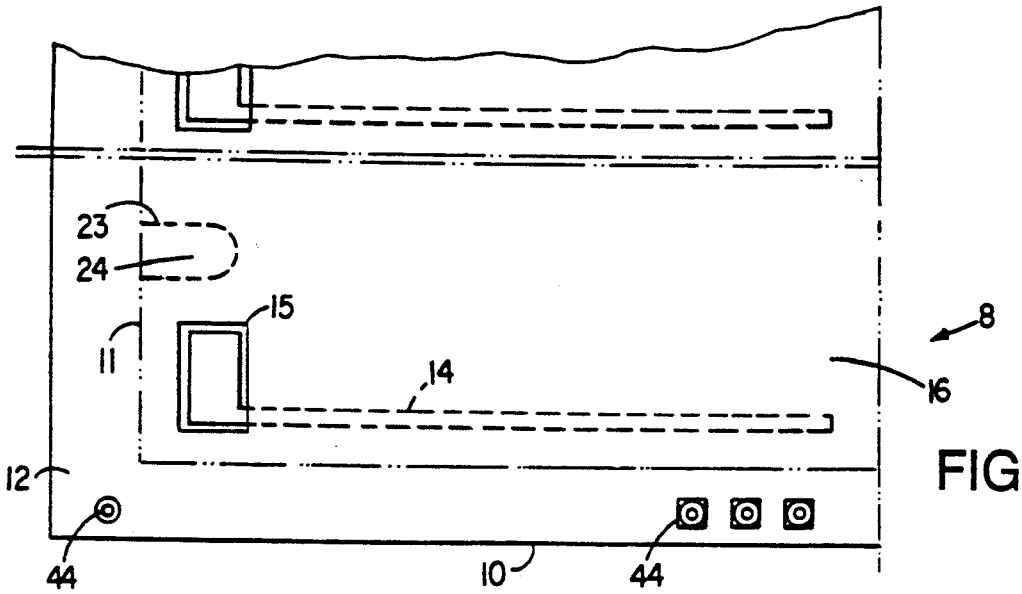

FIG. 8*a* is a view similar to that of FIG. 8 showing the lamp after the first conductive layer has been laser scribed to isolate the localized region of the respective electrode.

Figure 8B:
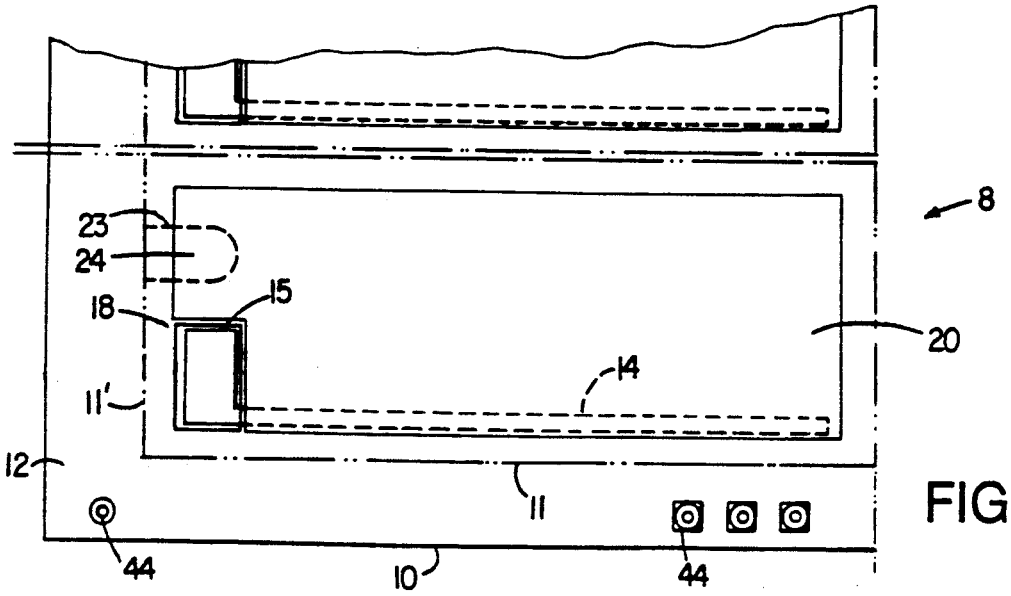

FIG. 8*b* is a view similar to FIG. 8*a* showing the lamp after a phosphor layer has been applied over the first electrode layer and the laser scribed line.

Figure 9:
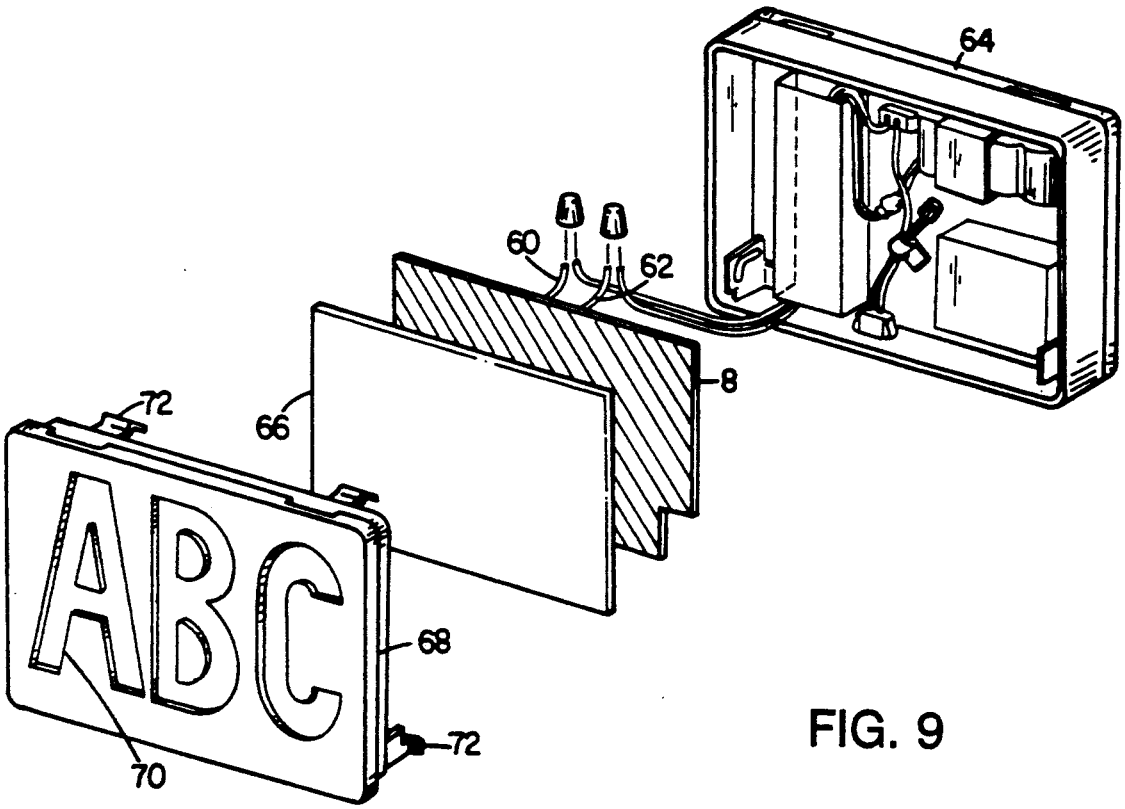

FIG. 9 is an exploded view of a sign employing the lamp of the present invention.

DETAILED DESCRIPTION

Figure 1:
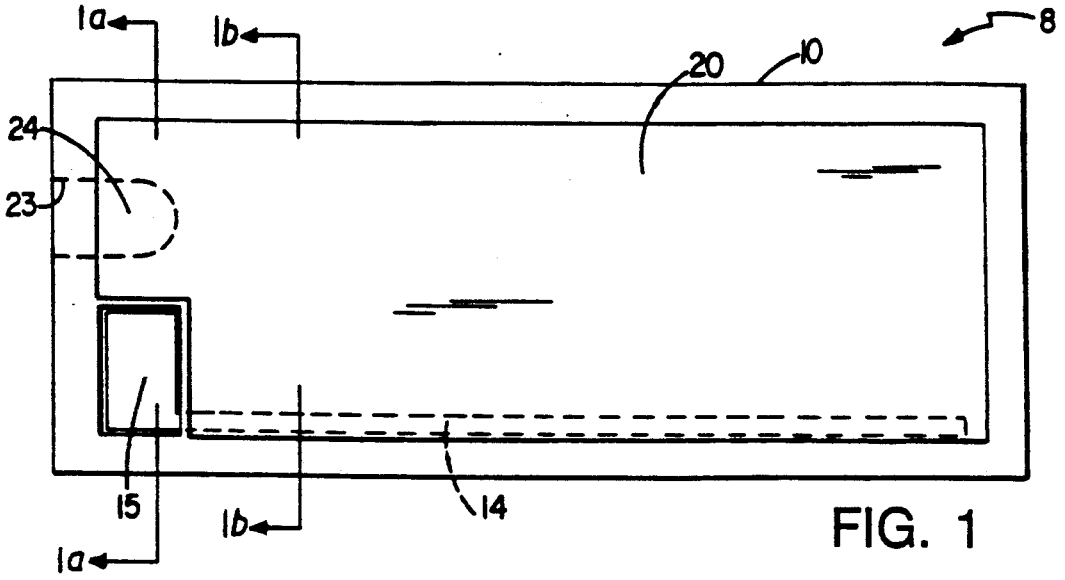

Referring to FIG. 1, there is shown a top view of an electroluminescent lamp 8 after it is cut with other such lamps from a panel (see FIG. 7). The panel comprises a clear substrate carrying a preapplied, general coating of a transparent conductor, on which the remaining layers have been deposited to comprise the lamp.

Figure 1A:
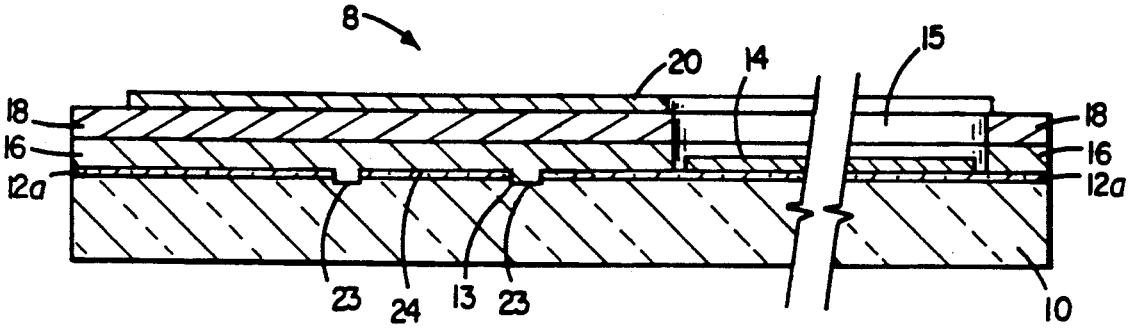
Figure 1B:
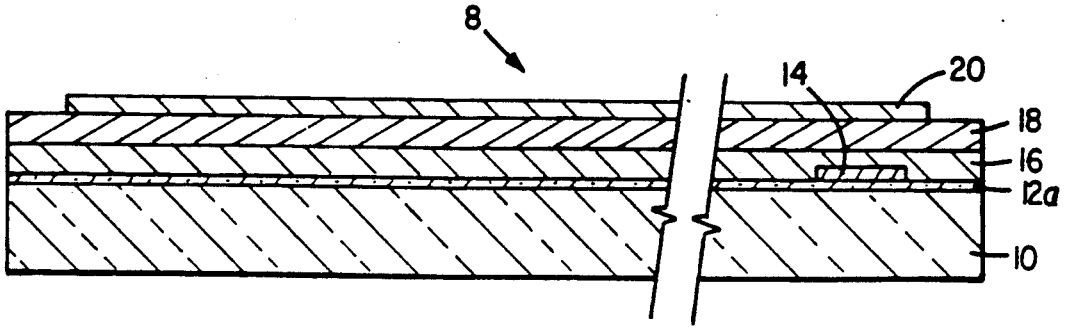
Figure 2:
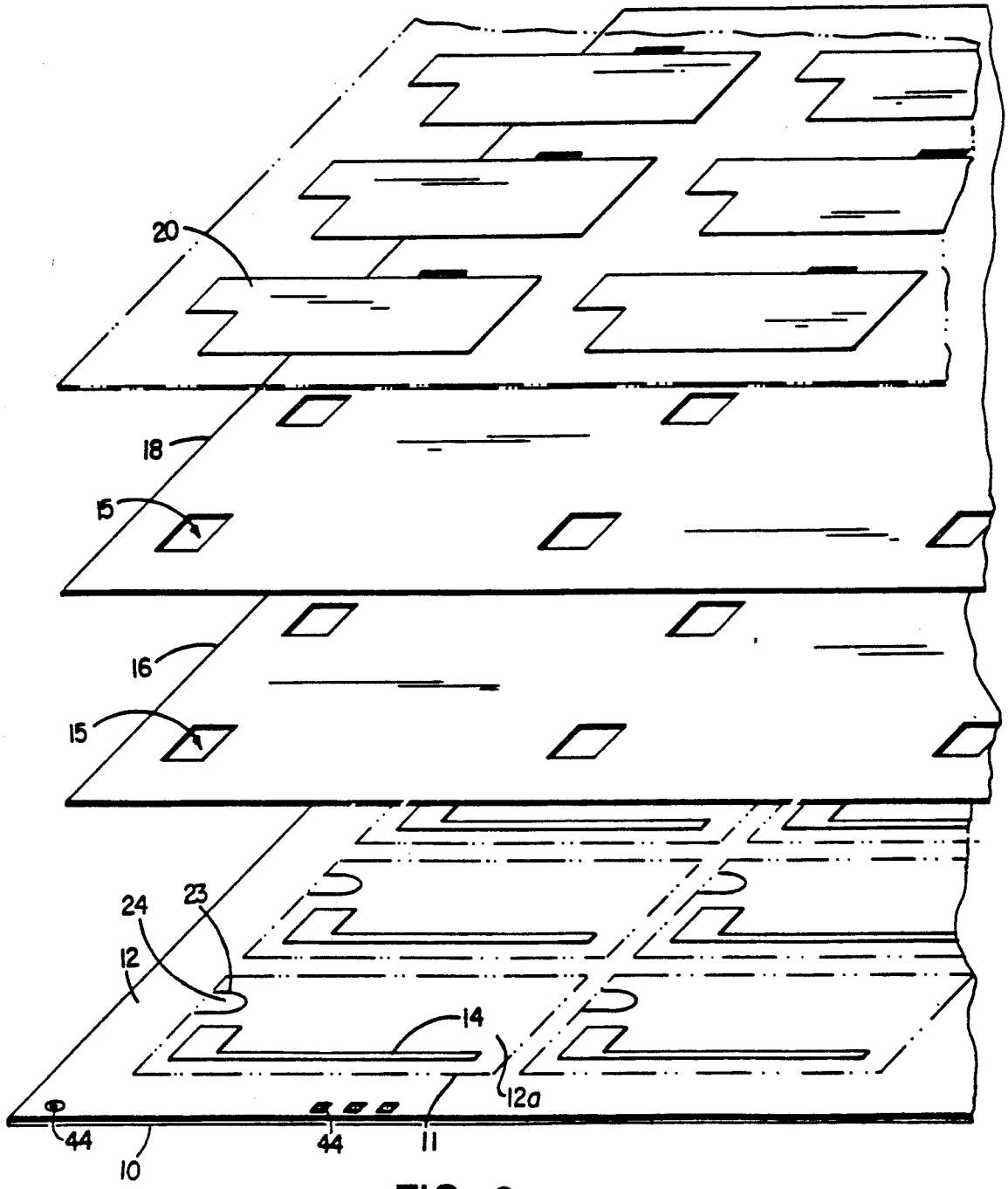
FIG. 2 is an exploded view of a panel of lamps, including the lamp of FIGS. 1, 1*a*, and 1*b* showing layers of the panel as separate elements.

As shown in the cross-sectional and exploded views of FIGS. 1*a* and 2, the lamp 8 includes a number of layers beginning with a transparent substrate 10, e.g., a sheet of polyester film, having a thickness of approximately 0.007 inches. In manufacture this lamp along with other lamps as shown in FIG. 7 are formed simultaneously by successive formation of the layers upon a panel of this substrate. Each lamp 8 is to be cut, as described below, along the dashed and dotted lines 11 in FIG. 2 (along the solid lines 11' in FIG. 7).

The substrate 10 has on one side a preapplied, general coating of a transparent conductive material, preferably, indium tin oxide (ITO), although aluminum oxide, gold, and silver, or other composite coatings may also be used. The ITO material is, preferably, vacuum sputtered onto a 48 inch web slit to narrower panel widths to provide a general coating that extends over the entire substrate panel, i.e., to the edges of the panel, to form a transparent front conductive coating 12 that is approximately 1000 Å thick. Sputter coating provides high conductivity as well as high optical transmission of light through the front coating 12.

For each lamp location on the panel there is next deposited an L-shaped bus bar 14 used to distribute power across the front of the lamp 8 when an electrical lead is attached to the bar by a connector, e.g., a crimp or eyelet type connector. Alternative embodiments (not shown) may or may not include such a bus bar. When included, the bus bar 14 is formed by screen printing a conductive ink, e.g., silver flakes dispersed in a polymeric resin carrier and dissolved with a suitable solvent, over the front conductive coating 12 in a layer approximately 0.0005 inches thick. The bus bar 14 is deposited within the outline 11 of the lamp 8. The solvent in the ink is then volatilized by placing the panel in an oven to remove the solvent and leave behind solid resin and silver which forms the bus bar 14.

Next, for each lamp, a line of interruption 23 is formed in the conductive coating 12 to isolate a localized region 24 of the conductive coating from electrical continuity with the remainder of the conductive coating. The remainder of the conductive coating 12, which includes the main portion of the coating, forms the front electrode 12*a*. Thus, electrical potential applied via a lead attachment connected to the bus bar 14 is applied to the front electrode 12*a* only and not applied to the localized region 24.

The line 23 defining the localized region 24 is preferably formed by laser scribing the ITO layer with a laser having a focused spot beam, with provisions for relative scan in the x and y directions of the panel relative to the laser. Other methods may also be used to scribe the line 23, including mechanical abrasion, e.g., using a razor blade to cut the ITO layer, water jet sprays, and chemical etching. However, $CO_2$ laser scribing is preferred for its ease of use and low cost. That is, the relative scanning of the laser upon the panel can be programmably controlled as described below in connection with FIG. 8, and does not require retooling screens and dies in order to change the pattern of the line 23. $CO_2$ lasers provide adequate processing capability at low capital and operating cost.

In another embodiment of the present invention, an excimer laser is used to form the line 23. The excimer laser can operate so as to flood a laser beam through a mask positioned above and across the entire area of the panel. The flood beam ablates the ITO layer forming the front conductive coating 12 in the area of the line 23 to be scribed, but, by proper selection of the wavelength of the laser, ablates little or none of the substrate 10. Alternatively, the excimer laser beam can be directed through a hole in a mask to form a spot beam and the line 23 is then formed by moving the panel under the beam. One advantage of these approaches is that the substrate 10 can be thinner, thereby making the lamp 8 more flexible. In addition a stronger lamp can result because the substrate 10 is not weakened in the area of the line 23 and is less likely to crack under stress. However, use of the excimer laser entails a certain amount of retooling to create different masks for multiple line patterns.

In an important aspect of the invention, laser scribing the line 23 cuts a groove 13 (FIG. 1*a*) through the ITO layer of the front conductive coating 12 down to the substrate 10. The conductive coating 12 is thereby divided into a main, inner portion 12*a* serving as the electrode and the localized region 24 which are electrically isolated from one another. Because this electrical isolation prevents electrical shorting between the conductive layers when a connector is attached to the second conductive layer in coincidence with the area of the isolated region 24, a connection means which deforms the sheet-form lamp, e.g., eyelet or crimp type connectors that pierce and/or compress the layers of the lamp, may be used. As a result, the lamp 8 is more reliable in harsh environments, has a greater life span, and can be more flexible and adaptable to specific applications.

Figure 1C:
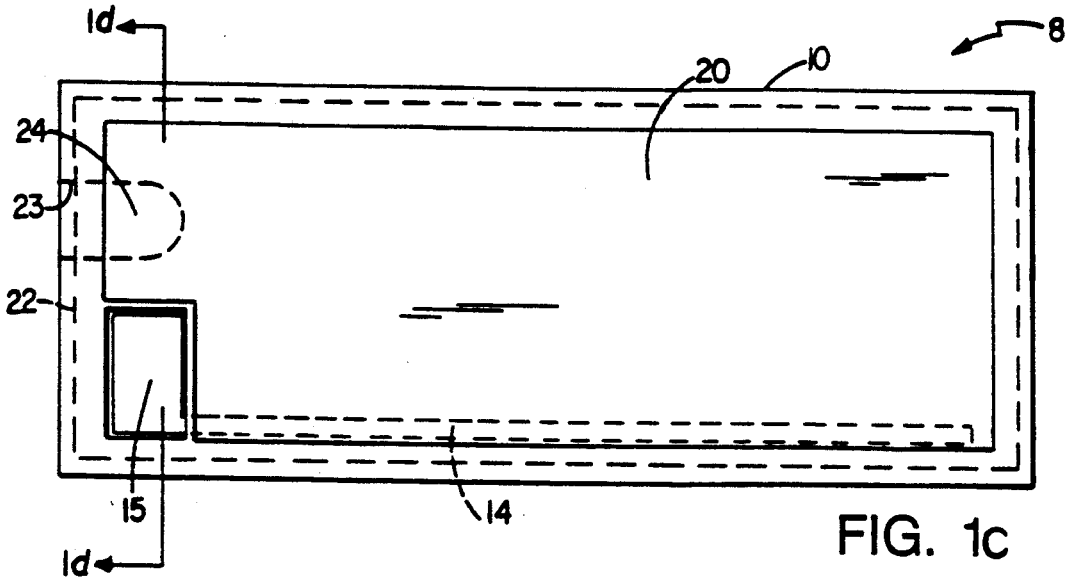
Figure 1D:
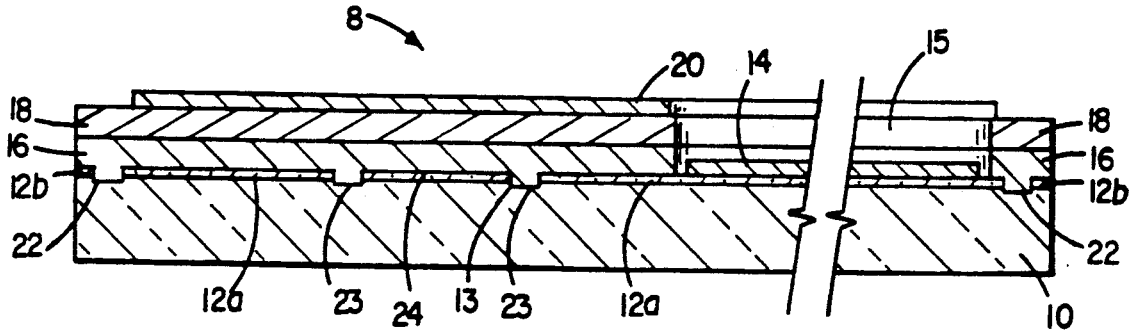

In an alternative embodiment shown in FIGS. 1*c* and 1*d*, the lamp of FIG. 1 can further include a second line of interruption 22 formed in the conductive coating 12 by laser scribing, as described above, to remove the ITO layer from the substrate 10 about the perimeter of the lamp and leave a narrow margin 12*b* of conductive coating electrically isolated from the main portion 12*a* of the conductive coating 12. Scribing the perimeter of the conductive coating 12 to deactivate one or more of its edges enables the lamp to be employed with completely bare edges in harsh environmental conditions. Such a lamp is less susceptible to electrical shorting between the two electrodes due to moisture making contact with the lamp at its edges, the occurrence of dendritic failure, i.e., darkened branching starting at the edges of the lamp caused by electro-chemical reactions within the lamp upon contact with moisture at the edges, and shock hazards due to an electrically energized layer being exposed at the edges of the lamp.

Referring again to FIG. 1*a*, the width and depth of the groove 13 depend primarily on the selected spot size and power of the laser beam, which can be focused or defocused to vary the dimensions of the line. In preferred embodiments, the width of the line 23 is between 0.005 and 0.010 inches, which is sufficient to prevent electrical arcing from the main portion 12*a* of the front conductive coating 12 across the line 23 to the localized region 24 under typical lamp operating conditions of 115 volts AC and 400 Hz. The line 23 may cut approximately 0.002 inches into the substrate 10 to ensure electrical separation between the main portion 12*a* and the localized region 24 of the coating. As shown in FIG. 1*a*, the resulting groove 13, if present, is then filled with material from one of the subsequent layers of the lamp 8 which are described below.

As shown in FIGS. 1*a* and 2, the front conductive coating 12, bus bar 14, and isolation line 23 are covered with a phosphor layer 16 formed of electroluminescent phosphor particles, e.g., zinc sulfide doped with copper or manganese, which are dispersed in a polymeric binder. Suitable binders include cyanoethyl cellulose, cyanoethyl pullulan, or polyvinylidende fluoride and its copolymers, all of which are commercially available. In cases where the barrier qualities of the successive layers are insufficient to prevent access of moisture through the thickness of the lamp to the phosphor particles, the phosphors employed can be of the encapsulated type in which each phosphor particle has its own protected outer coating that prevents entry of deleterious moisture. Such coatings include 72×, available from Sylvania/GTE, and coatings disclosed in U.S. Pat. No. 4,855,189 and in co-pending application Ser. No. 07/514,440, filed Apr. 25, 1990, which as noted above is incorporated hereby by reference. The phosphor layer 16 is applied to the front conductive coating 12, e.g., by screen printing or other coating methods, and has a thickness of approximately 0.001 inches.

In the embodiment shown in FIG. 1*a*, the phosphor layer 16 extends over the inner electrode portion 12*a* and localized region 24 of the front conductive coating 12, thereby filling in the groove 13 as shown in FIG. 1a. The phosphor layer 16 is screen printed so as to leave an exposed window 15 above a portion of the bus bar 14 to which an adhesive front lead connection can be attached.

The next layer of the lamp 8 is a dielectric layer 18, formed of a high dielectric constant material, e.g., barium titinate, dispersed in a polymeric binder such as one of those mentioned above. The dielectric layer 18 measures approximately 0.001 inches thick and is screen printed over the phosphor layer 16 so that it extends to the edges of the lamp 8 but leaves the area of window 15 uncovered.

Deposited above the dielectric layer is a rear electrode 20, formed of conductive particles, e.g., silver, carbon, or nickel, dispersed in one of the polymeric binders mentioned above to form a screen printable ink. The ink is applied, e.g., screen printed, over the dielectric layer 16 to form the rear electrode 20 in a layer approximately 0.0005 inches thick. The rear electrode 20 terminates back from the edges of the lamp 8 between 0.010 and 0.050 inches, thereby reducing the possibility of shorting between the rear electrode and the front electrode.

Finally, in some applications of the lamp 8, an additional insulating layer (not shown) is applied over the rear electrode 20, e.g., to prevent possible shock hazards or to provide a moisture barrier to protect the phosphor particles. When included, the insulating layer may be screen printed over the rear electrode 20, or laminated as a performed layer to the lamp using a pressure sensitive adhesive or similar means, or flood coated, etc. When applied as a preformed layer, the insulating layer can be a preformed film where an area of the film corresponding to the window 15 is cut and peeled away to allow an electrical connection to the front conductive coating 12. The area of the window 15 can be cut and removed by laser scribing after the film is applied over the dielectric layer 18 (in much the same way as the front conductive coating 12 is laser scribed after it is applied to the substrate 10), or the area of the window can be cut from the film before it applied to the dielectric layer.

Electrical connectors are then applied to the bus bar 14 and the rear electrode 20 to connect electrical leads to the lamp 8. As mentioned above, adhesive connectors may be applied to the bus bar 14 and the rear electrode 20 to connect electrical leads to the lamp 8. However, other, sturdier connections are preferred and are made possible by the electrical isolation of the localized region 24 which prevents shorting between the conductive layers when a connector is attached to the second conductive layer in coincidence with the area of the isolated region. Furthermore, a connection means that deforms the sheet-form lamp, e.g., by piercing and/or compressing the layers of the lamp, may be used. For example, the embodiment of FIG. 3 shows eyelets 26 and 27 which connect with and carry power to the rear and front electrodes 20 and 12. The eyelets 26 and 27 are typically brass or tin-plated brass barrels which are rolled over on each end. The eyelets 26 and 27 are inserted through holes cut by the laser in the lamp 8 and are crimped in place or soldered to provide a secure electrical connection to the electrodes 12 and 20 of the lamp. FIGS. 4 and 4a show a conductive pin 29 having a head 29a and a shaft 29b which extends in a press fit through the eyelet 26 in the lamp 8 and in a socket 31 in a printed circuit board 33 to make a connection between the lamp and the board.

Referring to FIG. 5, copper ribbon leads 33 can be captured between the eyelets 26 and 27 of the lamp 8 to provide power to the electrodes 12 and 20. Alternatively, crimp-on termination connectors 35 (FIG. 6) may also be used, e.g., pin crimp part #88997-2 distributed by AMP. The connectors 35 have fingers 37 which pierce the lamp and curl inwardly to clamp the connector in place. Again, electrical isolation of the localized region 24 prevents shorting due to contact between a connector in the localized region and both conductive layers.

Referring to FIG. 7, there is shown a panel 40 of lamps 8, each of which is essentially identical to the lamp 8 described above in connection with FIGS. 1, 1a and 2. Panel 40 measures approximately 12 by 15 inches and includes registration targets 44 along its outer edges. The registration targets 44 are applied, e.g., screen printed, onto the front conductive coating 12 on the panel 40 and may be punched out or cut by the laser or other means, to form registration points used subsequently by the laser and the screen printing devices to assure proper registration. The laser is typically mounted on a gantry that moves in one direction (X), while the lamp 8 is mounted on a table that moves in the other direction (Y), relative to the laser. Both the gantry and the table are numerical control (NC) machines, programmed to move in a coordinated manner and to turn the laser on and off at appropriate points to form the line 23. In this way, the NC machines, i.e., the laser and moveable table, move the panel relative to the laser to form the isolation line in each of the lamps 8 and upon completion of the sandwich to cut the panel 40, i.e., along lines 11', into individual lamps. In this way, the present invention permits a great degree of flexibility in the manufacture of lamps having complex shapes since the NC machines can be programmed to scribe the line at any desired offset margin from the shape of the lamp.

Referring to FIGS. 8, 8a, and 8b, a single lamp 8 of the panel 40 is shown in various stages of construction. Substrate 10 which forms the first layer of the panel 40, is coated with a transparent conductive coating, e.g. ITO, as by sputter coating. If the transparent conductive coating is applied by use of a solvent, the panel 40 is then placed in an oven and baked to remove solvents in the ITO material.

The bus bar 14 is then screen printed over the front conductive coating 12 of each lamp 8. Again, the entire panel 40 is placed in an oven to volatilize and remove any solvents used in forming the bus bar. After the bus bar 14 is applied, alignment pins on the movable table (not shown) are inserted through the registration targets 44, thereby allowing the NC machines to move the panel so that selected areas are positioned under the laser beam. Referring to FIG. 8a, the front conductive coating 12 is divided into an scribing the line 23 about a localized region 24 of each lamp 8 and a coating of phosphor 16 is then applied. Referring to FIG. 8b, the remaining layers of dielectric 18 and rear electrode 20 are successively applied over the panel, leaving window 15 open on each lamp so that a lead attachment may be made to the front conductive coating 12a via the bus bar 14. Having thus formed each of the lamps 8 on the panel 40, the panel is repositioned in the table and the laser is used to cut each of the lamps 8 out of the panel 40, i.e., along lines 11'. Electrical leads are then attached to the front conductive coating 12a in the exposed area of the bus bar 14 and to the rear electrode 20.

The finished lamp 8 has many possible applications. Referring to FIG. 9, the lamp 8 is used to light a sign and is connected via conductive leads 60 and 62 to electronics which provide power to the lamp. The electronics are located in a plastic or metal housing 64 which can be mounted on a wall. The lamp 8 fits within the housing 64 and is covered with a transparent sheet 66 which can be tinted in some preferred color, e.g., red, to alter the color of the light emitted through the sheet. Finally, a cover 68 having stenciled letters 70, i.e., "ABC", or graphics through which light from the lamp is emitted is fitted over the sheet 66 and the lamp 8 and connected to the housing 64 with clip members 72.

Other embodiments of the lamp 8 are, of course, possible. For example, the line of interruption may be formed through the multiple layers of the lamp, e.g., through the phosphor and ITO layers, rather than through the ITO layer alone. Furthermore, additional layers may be included in the lamp between the layers described above to accomplish specific effects. For example, an unfilled resin layer between the second conductive layer and the dielectric layer can be added to provide a better physical bond between the two layers. Other layers may be included to provide vapor barrier effects.

In another embodiment (not shown), the lamp is formed from the rear electrode forward. That is, a first conductive coating, which may be transparent or non-transparent, is deposited, preferably by sputter coating as described above, over a substrate film and a line of interruption is formed in the coating to divide the coating into a main portion forming the rear electrode and a localized region electrically isolated from the main portion. Subsequently, a dielectric layer is deposited over the first conductive coating and fills the groove formed by the line of interruption. Phosphor material is deposited over the dielectric layer, and a transparent, conductive coating forming the front electrode is deposited over the phosphor layer so that it terminates back from the edges of the lamp between 0.010 and 0.050 inches. Finally, a clear, insulation coating may be applied to the front electrode to protect it and prevent shock hazards. In alternative embodiments of the lamp formed from the rear electrode forward, the substrate film and conductive coating may be separately prepared, laser scribed as described above, and laminated onto the remaining layers of phosphor, dielectric and front electrode to form the lamp structure.

Other embodiments are within the following claims.

We claim:

1. In an electroluminescent sheet-form lamp comprising a transparent insulation layer, a transparent first conductive layer below said insulation layer forming a first electrode, a layer of phosphor material below said first conductive layer, a layer of dielectric material below said phosphor layer, a second conductive layer below said dielectric layer forming a second electrode, and first and second electrical connection means for applying an electrical potential between the conductive layers to cause the phosphor to transmit light through the transparent conductive layer and said transparent insulation layer, one of said conductive layers having been formed as a general conductive coating preapplied over a panel of larger dimension than said lamp, from which said lamp has been cut, the improvement providing improved electrical connection, wherein said one of said conductive layers has a line of interruption which isolates a localized region of said one of said conductive layers from electrical continuity with a main portion of said one of said conductive layers, said localized region and said main portion comprising in aggregate said one of said conductive layers, said main portion of said one of said conductive layers forming the respective electrode and being connected to said first connection means to apply electrical potential thereto without applying electrical potential to said localized region, the second connection means for the other of said conductive layers which forms the other of said electrodes being located in coincidence with the area of said localized region, said second connection means resulting in deformation of the sheet-form lamp, whereby the electrical isolation of said localized region prevents electrical shorting between said conductive layers as a result of said deformation.

2. The electroluminescent lamp of claim 1 further comprising a second insulation layer below said second conductive layer.

3. The electroluminescent lamp of claim 2 wherein one of said insulation layers forms a substrate upon which subsequent layers of said lamp are applied.

4. The electroluminescent lamp of claim 1 wherein said one of said conductive layers is said first conductive layer and said other of said conductive layers is said second conductive layer.

5. The electroluminescent lamp of claim 1 wherein said one of said conductive layers is said second conductive layer and said other of said conductive layers is said first conductive layer.

6. In an electroluminescent sheet-form lamp comprising a transparent substrate layer, a transparent first conductive layer over said substrate layer forming a first electrode, a layer of phosphor material over said first conductive layer, a layer of dielectric material below said phosphor layer, a second conductive layer below said dielectric layer forming a second electrode, and first and second connection means associated with respective conductive layers for applying an electrical potential between said electrodes to cause the phosphor to transmit light through the transparent first conductive layer and the transparent substrate, said first transparent conductive layer having been formed as a general conductive coating preapplied over a panel of said substrate layer of larger dimension than said lamp, the improvement providing improved electrical connection, wherein said first conductive layers has a line of interruption which isolates a localized region of said first conductive layer from electrical continuity with a main portion of said first conductive layer, said main portion of said first conductive layer forming said first electrode and being connected to said first connection means to apply electrical potential thereto without applying electrical potential to said localized region, the second connection means for said second conductive layer that forms said second electrode being located in coincidence with the area of said localized region, said second connection means employing deformation of the sheet-form lamp, whereby the electrical isolation of said localized region prevents electrical shorting between said conductive layers as a result of said deformation.

7. The electroluminescent lamp of claim 1 or 6 wherein connection of said second connection means to its respective conductive layer is formed by compression of the thickness of the sheet-form member.

8. The electroluminescent lamp of claim 7 wherein said connection is formed by crimping said second connection means onto said sheet-form member.

9. The electroluminescent lamp of claim 1 or 6 wherein said second connection means comprises an eyelet clamped on said sheet-form member at an opening through its thickness.

10. The electroluminescent lamp of claim 1 or 6 wherein said second connection means comprises a thickness-penetrating member such as a conductive pin or stake.

11. The electroluminescent lamp of claim 1 or 6 wherein said second connection mans attaches to said first and second electrodes by piercing said conductive layers.

12. The electroluminescent lamp of claim 1 or 6 wherein said line f interruption begins at an outer edge of a respective one of said conductive layers, extends away from said outer edge into the interior of said conductive layer, and turns back to said outer edge in the manner to extend about and isolate said localized region at the edge of said respective conductive layer.

13. The electroluminescent lamp of claim 1 or 6 wherein said line of interruption is disposed inwardly from all edges of a respective one of said conductive layers, said line of interruption being closed upon itself to define said localized region as an island within the perimeter of said respective conductive layer.

14. The electroluminescent lamp of claim 1 or 6 wherein said line of interruption forming said localized region is a laser scribed line.

15. The electroluminescent lamp of claim 6 wherein an insulation layer is provided over said second conductive layer.

16. The electroluminescent lamp of claim 1 or 6, said lamp further comprising an edge region susceptible to formation of a detrimental, electrically conductive path, wherein the main portion of a respective one of said conductive layers is isolated from the susceptible edge region by isolation provided along at least a portion of the perimeter of the lamp as a result of removal of said preapplied conductive coating such that, at the edge region of said isolation, said main portion of said one of said conductive layers which forms the respective electrode commences at a line spaced inwardly from the outer edge of said lamp, said electrical connection for the respective conductive layer being made to said main portion and being electrically isolated from said susceptible edge region, whereby a lamp formed by cutting its outline from said panel of larger dimension provides a lamp for which the formation of said conductive path in said edge region does not cause an adverse effect.

17. The electroluminescent lamp of claim 16 wherein said preapplied conductive coating material has been removed to from a line of interruption that leaves in place a narrow margin of conductive coating in said edge region which is electrically isolated from the main portion of the coating forming the first electrode.

18. In an electroluminescent sheet-form lamp comprising, in successive relationship, a rear substrate layer, a preapplied conductive layer over said substrate layer forming a back electrode, a layer of dielectric material over said preapplied conductive layer, a layer of phosphor material over said dielectric layer, a transparent conductive layer applied over said phosphor layer forming a transparent electrode, and electrical connection means associated with respective conductive layers for applying an electrical potential between the conductive layers to cause the phosphor to transmit light through the transparent conductive layer, the improvement providing improved electrical connection, wherein said preapplied conductive layer that forms said back electrode has a line of interruption which isolates a localized region of said preapplied conductive layer from electrical continuity with a main portion of said preapplied conductive layer, said main portion of said preapplied conductive layer forming the rear electrode and being connected to a first one of said connection means to apply electrical potential thereto without applying electrical potential to said localized region, a second one of the connection means for said transparent conductive layer which forms said transparent electrode being located in coincidence with the are of said localized region, said second one of the connection means employing deformation of the thickness of the sheet-form lamp, whereby the electrical isolation of said localized region prevents electrical shorting between said conductive layers as a result of said deformation.

19. The electroluminescent lamp of claim 18 wherein connection of said second one of the connection means to said conductive layers is formed by compression of the thickness of the sheet-form member.

20. A method of providing improved electrical connection to an electroluminescent lamp, comprising providing an electroluminescent sheet-form lamp member comprising a transparent substrate layer, a transparent first conductive layer over said substrate layer forming a first electrode, a layer of phosphor material over said first electrode layer, a layer of dielectric material over said phosphor layer, a second conductive layer over said dielectric layer forming a second electrode, and first and second connection means to the respective electrode layers for applying an electrical potential between the electrode layers to cause the phosphor to transmit light through the transparent first electrode layer and the transparent substrate, one of said conductive layers having been formed as a general conductive coating preapplied over a panel of said substrate layer of larger dimension than said lamp, including providing in said one of said conductive layers, a line of interruption which isolates a localized region of said one of said conductive layers from electrical continuity with a main portion of said one of said conductive layers, said localized region and said main portion comprising in aggregate said one of said conductive layers, said main portion of said one conductive layer forming the respective electrode and having a connection made therewith to apply electrical potential thereto without applying electrical potential to said localized region, and making the connection for the other of said conductive layers which forms the other electrode in a location coincident with the area of said localized region, said connection means employing deformation of the sheet-form lamp, the electrical isolation of said localized region preventing electrical shorting between said conductive layers as a result of said deformation.

21. A method of providing improved electrical connection to an electroluminescent lamp, comprising providing, in successive relationship, a rear substrate layer, a preapplied conductive layer over said substrate layer forming a back electrode, a layer of dielectric material over said preapplied conductive layer, a layer of phosphor material over said dielectric layer, a transparent conductive layer applied over said phosphor layer forming a transparent electrode, and electrical connection means for applying an electrical potential between the conductive layers to cause the phosphor to transmit light through the transparent electrode, one of said conductive layers having been formed as a general conductive coating preapplied over a panel of said substrate layer of larger dimension than said lamp, including providing in said one of said conductive layers, a line of interruption which isolates a localized region of said one of said conductive layers from electrical continuity with a main portion of said one of said conductive layers, said localized region and said main portion comprising in aggregate said one of said conductive layers, said main portion of said one conductive layer forming the respective electrode and having a connection made therewith to apply electrical potential thereto without applying electrical potential to said localized region, and making the connection for the other of said conductive layers which forms the other electrode in a location coincident with the area of said localized region, said connection means employing deformation of the sheet-form lamp, the electrical isolation of said localized region preventing electrical shorting between said conductive layers as a result of said deformation.

* * * * *

UNITED STATES PATENT AND TRADEMARK OFFICE

CERTIFICATE OF CORRECTION

PATENT NO. : 5,276,382

DATED : January 4, 1994

INVENTOR(S) : Sharlyn R. Stocker, Ralph McGuigan, Rodney T. Eckersley and Will M. Hooke It is certified that error appears in the above-indentified patent and that said Letters Patent is hereby corrected as shown below:

Col. 8, line 57, insert --inner, main portion 12a and a localized region 24 by laser-- after "an" but before "scribing".

Col. 11, line 21, "f" should be --of--.

Signed and Sealed this

Twenty-ninth Day of August, 1995

Bruce Lehman

*Attest:*

BRUCE LEHMAN

*Attesting Officer*

*Commissioner of Patents and Trademarks*